United States Patent [19]

Whittingham

[11] 4,278,471

[45] Jul. 14, 1981

[54] PROCESS FOR EXTRACTING SUGAR FROM CELLULOSE AND CELLULOSIC MATERIALS

[75] Inventor: Barron S. Whittingham, Los Angeles, Calif.

[73] Assignee: Carl Eugene Dedlow, Venice, Calif.

[21] Appl. No.: 82,159

[22] Filed: Oct. 5, 1979

[51] Int. Cl.[3] ..... C13K 1/02

[52] U.S. Cl. ..... 127/37

[58] Field of Search ..... 127/37; 162/4, 5, 7, 162/14, 64, 84, 85

[56] References Cited

U.S. PATENT DOCUMENTS

| | | | |
|---|---|---|---|
| 1,428,217 | 9/1922 | Classen | 127/37 |
| 1,936,190 | 11/1933 | Dreyfus | 127/37 |
| 3,620,909 | 11/1971 | Gleason | 162/4 |
| 3,718,504 | 2/1973 | Whittingham | 127/37 |

*Primary Examiner*—Michael S. Marcus

*Attorney, Agent, or Firm*—Keith D. Beecher

[57] ABSTRACT

A process for producing glucose, which may be fermented into alcohol, from wood pulp cellulose. The wood pulp is produced by dispersing corrugated paper obtained, for example, from used cardboard boxes; or paper derived, for example, from used newspapers; or waste wood; as free fibers into water at ambient temperature, and by subsequently reducing the fibers to glucose by catalytic reduction and acid hydrolysis under heat and variable pressures.

4 Claims, No Drawings

PROCESS FOR EXTRACTING SUGAR FROM CELLULOSE AND CELLULOSIC MATERIALS

BACKGROUND

The prior art attempts to hydrolyze cellulosic materials into glucose have proven to be time consuming and uneconomical (Journal of the Chemical Society 1921, 83). An important objective of the present invention is to provide a process for the rapid and economical production of glucose from waste cellulose and waste cellulosic materials which, in turn, may be converted into alcohol by known processes, so as to represent an inexpensive and economical fuel source by which fuel may be produced from readily available and abundant materials.

DETAILED DESCRIPTION OF THE INVENTION

As a first step in the process of the invention, and as stated briefly above, a clean bleached, or unbleached wood pulp is produced at ambient temperature. The wood pulp may be produced, for example, by placing waste wood, used cardboard boxes, or used newspapers, into water in an appropriate tank. A non-ionic surfactant (1.5% based upon dried weight of pulp) is added to the aqueous mixture, and trisodiumphosphate ($Na_3PO_4$) (0.5%) is then added to the mixture. The resulting reactions bring about a rapid production of wood pulp fibers without any heat input.

The surfactant molecule is constituted by an hydrophobic fraction and an hydrophillic fraction. The hydrophobic fraction acts as a wetting agent and at times as a solvent. The hydrophobic fraction of the molecule acts as a partial solvent for the cellulosic binders, but acts primarily to polarize non-cellulose particles and prevents such particles from adhering to the cellulose fibers, so that they may be removed from the mixture.

The trisodiumphosphate is essential to control and stabilize the alkaline pH of the mixture. It is known that cellulose fibers rapidly disperse in water in an alkaline state (Dictionary of Applied Chemistry, 456–479 Thorpe), and this results in what is known as the hydration of the cellulose particles which is illustrated by $2(C_6H_{10}O_6).NaOH$. The trisodiumphosphate does not ionize as readily as sodium hydroxide in the pulp mixture, and it reacts readily with such inorganic impurities as iron, calcium, and others, such that when the pulp is reduced to glucose in the ensuing steps of the process, very little organic or inorganic impurities are entrained in the resulting glucose.

The next step in the process is to wash the cellulose pulp free of chemicals until a pH of 7.0 is achieved. The wet pulp is then de-watered to a desired degree of moisture, and it is ready to be reduced and hydrolyzed into glucose.

For the next step in the process the pulp is placed in a closed vessel with water at ambient temperature, and sulphur dioxide ($So_2$) is added as a catalyst and reducing agent. The pressure within the vessel is then raised to 2–4 atmospheres by air pressure for approximately 1.3 hours. Calcium sulfite ($CaSO_3$) may be used as a catalyst in an acidic medium, and it reacts to release additional sulphur dioxide ($SO_2$) for accelerated reduction of the cellulose fibers. As a result, the linkages between the cellulose fibers are broken. The vessel is maintained at ambient temperature because greater solubility of the sulphur dioxide occurs at ambient temperature than at elevated temperatures.

The sulphur dioxide ($SO_2$) is then released from the vessel, preferably into an alkaline medium to form by-products. After most of the sulphur dioxide has been removed from the vessel, sulphuric acid ($H_2SO_4$) is added to the water and pulp in the vessel, and the vessel is again closed and the desired hydrolysis takes place. The basic reaction may be characterized as:

$$SO_2 + CO_2 + H^+ \rightleftharpoons H_2SO_3 + H_2CO_3 + C_6H_{12}O_6 \rightarrow H_2O + Co_2$$

The volumetric evolution of carbon dioxide ($CO_2$) is a measure of the glucose formed from the cellulose. $H^+$ represents the acid added. The time and pressure for the hydrolysis of the cellulose to glucose are variables, because too much elevated pressure and temperature can cause destruction of the glucose formed from the cellulose.

The cellulose pulp is rapidly and completely transformed into glucose in accordance with the process of the invention as represented by the following chemical formula:

$$\frac{(C_6H_{10}O_5)x}{\text{cellulose}} \rightarrow \frac{(C_6H_{12}O_6)}{\text{D}-(+)\text{ glucose}}$$

Where the cellulose formula X is now no more than a statistical average, which may be 100, 200 or more. It has been found that the hydrolysis of the cellulose by the process of the invention provides a high yield of D-glucose.

EXAMPLE 1

Dried wood pulp fibers prepared, for example, in the manner described above in an amount of 100 grams is mixed with 300–500 cc water in an appropriate container at ambient temperature and pressure. Sulphur dioxide ($So_2$) in an amount of 3–5 cc is added to the mixture and the container is agitated for about 1.3 hours at 2–4 atmospheres by air pressure. Sulphuric acid ($H_2SO_4$) in an amount of 5 grams is then added to the mixture, and the mixture is placed in an autoclave, or other appropriate pressure vessel. The pressure is slowly raised to 15 PSI by heating and held at that pressure for one hour. The pressure is then raised to 30 PSI and held at that pressure for another hour. Finally, the pressure is raised to 40 PSI and held at that pressure for an additional hour. Gases from the pressure vessel are then released into an alkaline medium to produce by-products. The resulting hydrolysate within the pressure vessel is dissolved cellulose fibers. The hydrolysate is neutralized with barium or calcium to a pH of 7.0–7.2 and concentrated in a vacuum to the desired Baumé. The resulting syrup contains D-glucose with a 96–97% concentration. The syrup may be fermented by known means to produce alcohol appropriate for burning as a fuel.

The hydrolysate may be tested for glucose by recrystallization of a quantity of the hydrolysate from absolute alcohol which will show a yield of white crystals (M.P. 144°–145° F.) (uncorrected), and glucose phenylosazone (M.P. 204°-205° F.) (uncorrected), yielding D-glucose (96-97%).

EXAMPLE 2

Dried wood pulp prepared, for example, as described above in an amount of 500 grams is mixed with 1500-2500 cc water in an appropriate container at ambient temperature and pressure. Sulphur dioxide ($SO_2$) in an amount of 1.5 grams is added to the mixture and 3.5 grams calcium sulfide ($CaSO_3$) is also added, and the mixture is agitated for about 1.5 hours at 2-4 atmospheres by air pressure. Sulphuric acid in an amount of 60 grams is added and the mixture is placed in a pressure vessel. The pressure within the pressure vessel is raised to 30 PSI by heating within 1.5 hours and is maintained at that pressure for 2.5 hours. The final steps of Example 1 are then followed to produce the glucose.

The invention provides, therefore, an improved process, by which waste materials, such as newspapers and cardboard boxes may be formed into an appropriate wood pulp, and the wood pulp may be quickly and efficiently reduced and hydrolized to glucose which, in turn, may be fermented into alcohol to serve as an appropriate fuel.

It will be appreciated that while particular embodiments of the invention have been shown and described, modifications may be made. It is intended in the claims to cover the modifications which come within the spirit and scope of the invention.

What is claimed is:

1. A process for producing glucose from pulp cellulose which comprises the following steps: dispersing paper or wood into a solution comprising water, a nonionic surfactant and trisodium phosphate to form a pulp; washing the pulp free of chemicals until a pH of the order of 7.0 is achieved; dewatering the pulp to a selected degree of moisture; placing the pulp in a closed vessel with water to form an aqueous mixture; adding sulphur dioxide ($SO_2$) to the aqueous mixture within the vessel at ambient temperature; raising the pressure of the aqueous mixture in the vessel to a selected increased pressure of between two and four atmospheres; agitating the aqueous mixture in the vessel at the selected increased pressure and at ambient temperature to reduce the cellulose fibers of the pulp in the aqueous mixture; releasing the sulphur dioxide ($SO_2$) from the vessel; adding sulphuric acid ($H_2SO_4$) to the aqueous mixture in the vessel; raising the pressure within the vessl to 15 psi by heating, and subsequently increasing the pressure to 30 psi and finally increasing the pressure to 40 psi, each increment of increased pressure being maintained for a preselected time, thereby to cause the sulphuric acid ($H_2SO_4$) to hydrolyze the cellulose in the mixture to a hydrolysate containing dissolved cellulose fibers; and neutralizing the hydrolysate to a pH of the order of 7.0 to produce a syrup containing -D glucose.

2. The process defined in claim 1, in which the pressure of the aqueous mixture in the vessel after the addition of the sulphur dioxide ($SO_2$) but before the addition of the sulphuric acid ($H_2SO_4$) is maintained for approximately 1.3 hours.

3. The process defined in claim 1 wherein each preselected time is approximately one hour.

4. The process defined in claim 1, and which includes the step of adding calcium sulfite ($CaSO_3$) to the aqueous mixture prior to the addition of the sulphuric acid ($H_2SO_4$) to regenerate the sulphur dioxide ($SO_2$) for accelerated reduction of the cellulose fibers.

* * * * *